United States Patent [19]

Blodee

[11] 4,081,199

[45] Mar. 28, 1978

[54] CHAIR GROUPING

[76] Inventor: Leif Blodee, 293 S. Lakeshore Dr., Holland, Mich. 49423

[21] Appl. No.: 802,719

[22] Filed: Jun. 2, 1977

[51] Int. Cl.[2] ..... A47C 1/12

[52] U.S. Cl. ..... 297/232; 297/244; 297/248; 297/440

[58] Field of Search ..... 297/232, 244, 248, 249, 297/440

[56] References Cited

U.S. PATENT DOCUMENTS

| | | | |
|---|---|---|---|
| D. 194,974 | 4/1963 | Kasparian | 297/244 X |
| 1,788,039 | 1/1931 | Wujcik | 297/244 |
| 3,371,956 | 3/1968 | Jordan et al. | 297/248 X |
| 3,708,204 | 1/1973 | Wachsmann | 297/440 |
| 3,841,701 | 10/1974 | Sullivan | 297/248 |
| 3,884,524 | 5/1975 | Eberle | 297/232 |

FOREIGN PATENT DOCUMENTS

| | | | |
|---|---|---|---|
| 929,238 | 7/1947 | France | 297/440 |
| 245,327 | 7/1947 | Switzerland | 297/440 |
| 895,694 | 5/1962 | United Kingdom | 297/440 |

*Primary Examiner*—Francis K. Zugel
*Attorney, Agent, or Firm*—Emrich, Root, O'Keeffe & Lee

[57] ABSTRACT

Seating structure for a chair grouping includes a frame having a lower U-shaped front runner for each chair and a separate side frame member extending upwardly from the top of the runner at each side and rearwardly about the back cushion. For in-line chair arrangements, the side frame members extend downwardly at the center of the chair back and are connected to U-shaped rear runners of adjacent chairs. For zig-zag chair arrangements, the side frame members extend rearward of the chair back to provide for a row of oppositely facing chairs and thence downwardly where they are connected to U-shaped front runners of the opposed chairs which are staggered relative to the first chairs. The side frame members are interchangeable, as are the runners; and they are connected together by means of an H-shaped connector which also serves to connect the seat of the chairs to the frame.

8 Claims, 20 Drawing Figures

CHAIR GROUPING

BACKGROUND AND SUMMARY

The present invention relates to a seating structure for providing a group of individual chairs. Chair groupings of this type are used in reception rooms, lounges, and in many places where it is desired to provide individual seating for a number of persons in relatively close proximity, but with individual seating for comfort and some privacy.

In chair groupings of this type, it is desirable, from the viewpoint of economy and manufacturing efficiency, to use as few elements as possible and to have interchangeable parts, while providing the individuality, comfort and aesthetics that are desired in this market. Another desirable feature of a chair grouping system is that it be flexible in the sense that it might be adapted for many different uses, yet carry through each grouping the same aesthetic value. Thus, the present invention provides flexibility in that it may be used either in a zig-zag seating arrangement (with two rows of oppositely facing chairs) which might be used in the center of a room, an in-line grouping (a single line of chairs all facing the same direction) which might be used against the wall, as well as individual chairs. Further, the structure readily adapts itself to the inclusion of related furniture such as a table, a lamp pad, or a planter.

Briefly, the present invention provides a frame having a lower U-shaped front runner for each chair and a separate side frame member extending upwardly from the top of the runner at each side and rearwardly about the back cushion.

In the case of an in-line chair arrangement, the side frame members extend downwardly at the center of the chair back and are connected to U-shaped rear runners of adjacent chairs. For a zig-zag chair arrangement, the side frame members extend upwardly from the front runners, then rearwardly about the chair back, and then further back side-by-side to provide for a row of oppositely facing chairs. The side frame members then extend downwardly where they are connected to U-shaped front runners of the opposed chairs which are staggered relative to the first row of chairs.

The side frame members for the zig-zag arrangement as well as the in-line arrangement are interchangeable, and so are the runners. The runners are connected to the side frame members by means of an H-shaped connector which also serves to connect the seat of the chair to the frame. The chair backs are connected to the side frame members, and the rear of the seat is attached to the rear of the back by a singular tubular connector.

The present invention thus provides a unique seating structure for groupings of individual chairs which may be used either in a zig-zag arrangement of oppositely facing rows, an in-line arrangement of a single row, or as individual chairs, in which case the side frame members extend about the chair backs and thence downwardly to form a rear center leg, joined together, again, by the H-shaped connector.

Other features and advantages of the present invention will be apparent to persons skilled in the art from the following detailed description of preferred embodiments accompanied by the attached drawing wherein identical reference numerals will refer to like parts in the various views.

THE DRAWING

Figure 14:
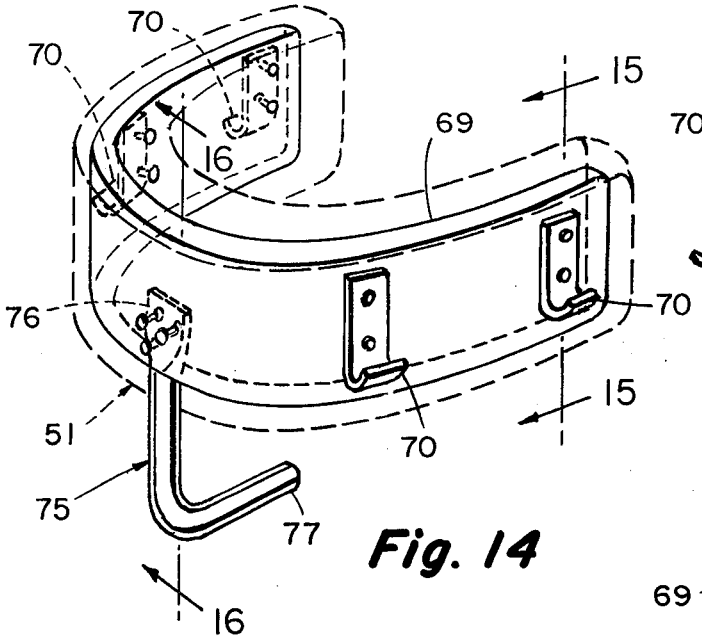
FIG. 14 is an upper right rear perspective view of the chair back with the cushions shown in phantom.
Figure 15:
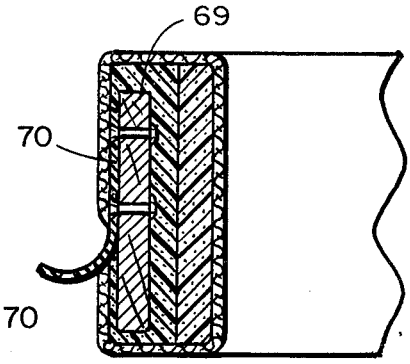
Figure 16:
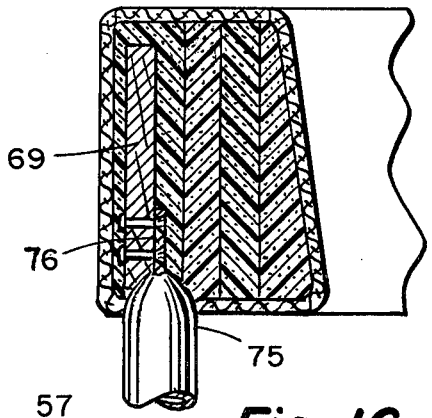
Figure 17:
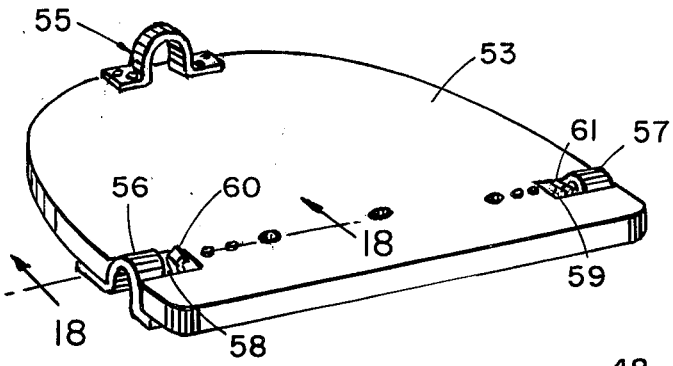
Figure 19:
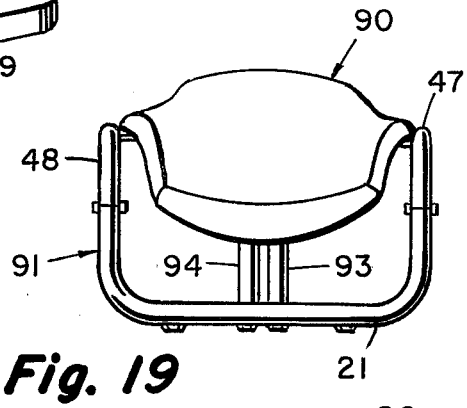
Figure 18:
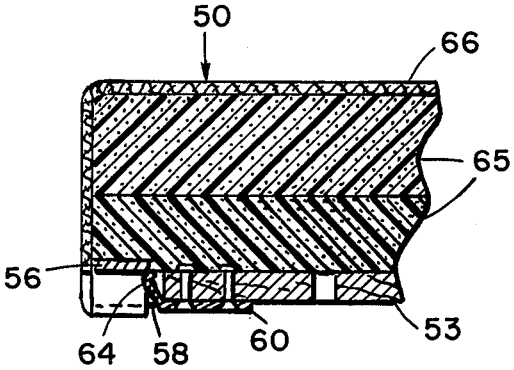
Figure 20:
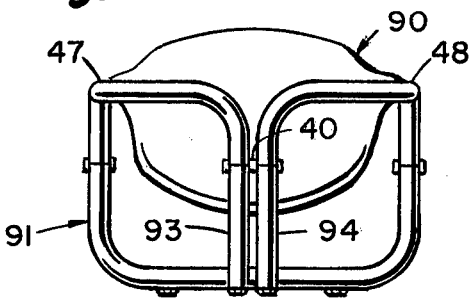

FIGS. 15 and 16 are fragmentary cross sectional views taken through the sight lines 15—15 and 16—16 respectively of FIG. 14;

FIG. 17 is an upper left frontal perspective view of the seatboard;

FIG. 18 is a fragmentary vertical cross sectional view of the assembled seat taken through the sight line 18—18 of FIG. 17; and FIGS. 19 and 20 are front and rear elevational views of an embodiment of a single chair incorporating the invention.

DETAILED DESCRIPTION

Figure 1:
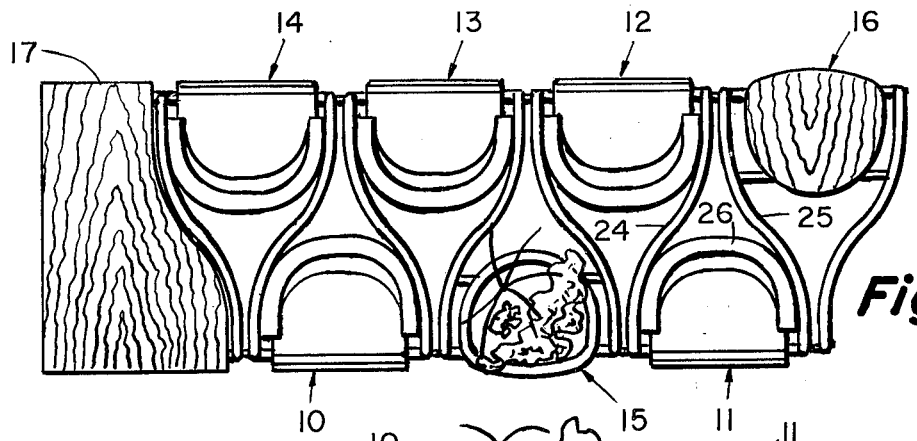
FIG. 1 is a plan view of a zig-zag seating arrangement incorporating the present invention.

Referring first to FIG. 1, five individual chairs are generally designated respectively 10, 11, 12, 13 and 14. The chairs 10, 11 are separated by a planter 15 for decorative purposes, but which also could be a chair. The chairs 10, 11 form one row, and the chairs 12–14 form an oppositely facing row, and the chairs of one row are seen to be in zig-zag or staggered relation with the chairs of the other. Next to the chair 12 is a small table 16 which may form a lamp support; and a larger end table 17 extends next to both chairs 10 and 14. All of the chairs are supported on a frame which is generally designated by reference numeral 20 in FIG. 3. The frame portion for the chair 11 includes a U-shaped front runner 21 which extends along the floor and is turned upwardly at its sides, designated 22 and 23. A pair of feet 24 are provided on the runner 21 two spaces from the floor. Connected to the upwardly turned portions 22, 23 of the runner 21 are first and second side frame members 24, 25. These side frame members are interchangeable, and they are seen to extend upwardly and rearwardly. They curve about a chair back 26 and then extend side-by-side from the center of the chair back to form the side frame elements of the chair 12 and table 16 (see FIG. 1).

Figure 3:
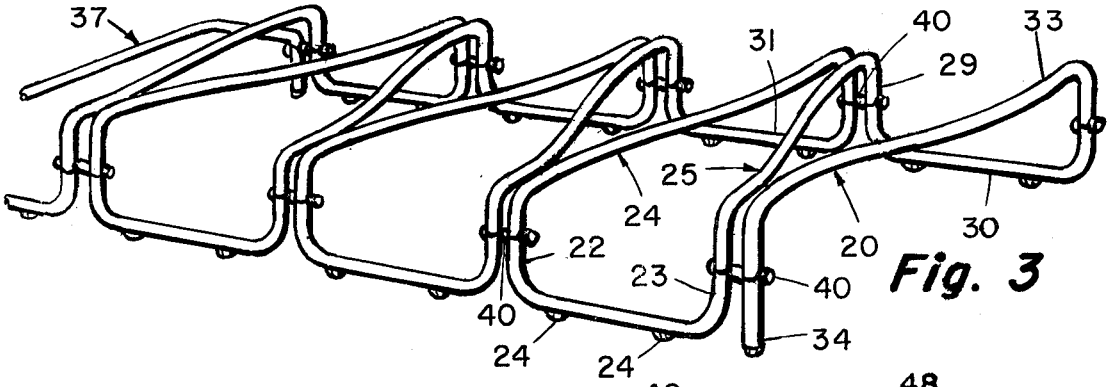
FIG. 3 is an upper perspective view of the frame of the grouping of FIG. 1.

The side frame members thence extend downwardly as at 28, 29 in FIG. 3 where they are connected to the adjacent sides of front runners 30, 31 which are similar to the previously described front runner 21. The front runner 30 forms the base of the table 16. At the right side of the front runner 30, there is a single side frame member 33 which extends around the table 16 and adjacent the chair 11 where it is provided with a leg 34 to complete the table support.

The frame 20 is thus constructed of similar elements including principally the U-shaped runners and the side frame members. A special tubular frame member shown at 37 in the left side of FIG. 6 may be used for the table 17 which is provided at a lower elevation (compare tables 16 and 17 in FIG. 2).

The side frame members are connected to their associated U-shaped front runners by means of a crane connector element generally designated 40 which is seen better in FIG. 12, and will be disclosed in more detail below. The connector 40 not only serves to join the frame members to each other, but to connect adjacent frames together to preserve the integrity of the group, and prevent separation of the chairs.

Figure 4:
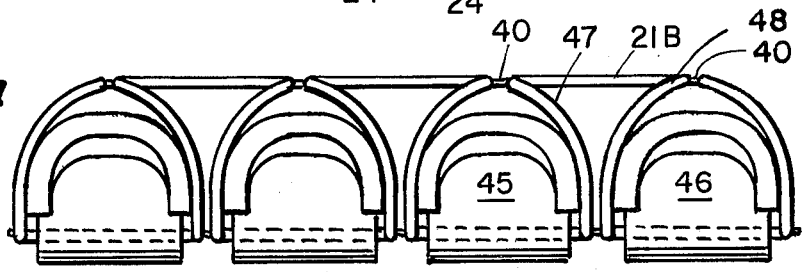
FIGS. 4–6 are respectively top, front and rear views of an in-line seating group.
Figure 5:
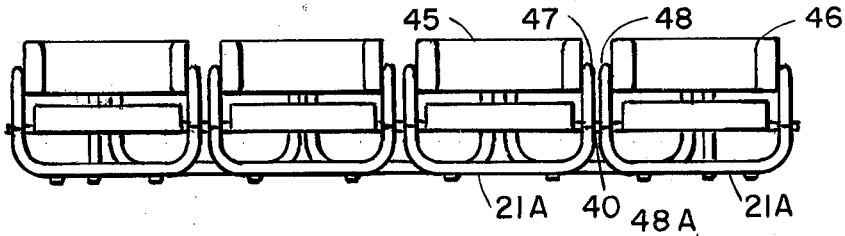
Figure 6:
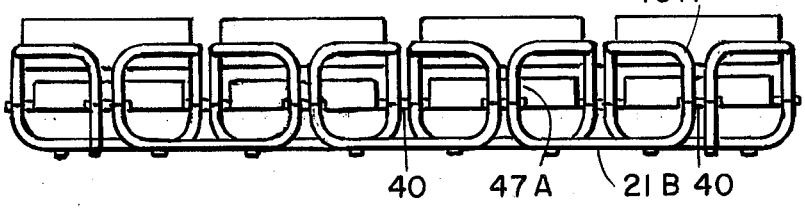

Turning now to FIGS. 4–6, an in-line chair grouping is shown using similar U-shaped front runners designated 21A in FIG. 5, and U-shaped rear runners 21B in FIG. 6 which are similar to the runners 21. For the two adjacent chairs designated 45, 46, adjacent side frame members are designated 47, 48 respectively. These side frame members are connected to their associated front runners by a frame connector 40, and they extend upwardly and thence rearwardly about their associated chair backs. Referring now to FIGS. 4 and 6, these side frame members extend approximately to the center of the chairs and are thence turned downwardly at 47A and 48A respectively where they are connected to a rear runner 21B, again by means of connectors 40.

Figure 7:
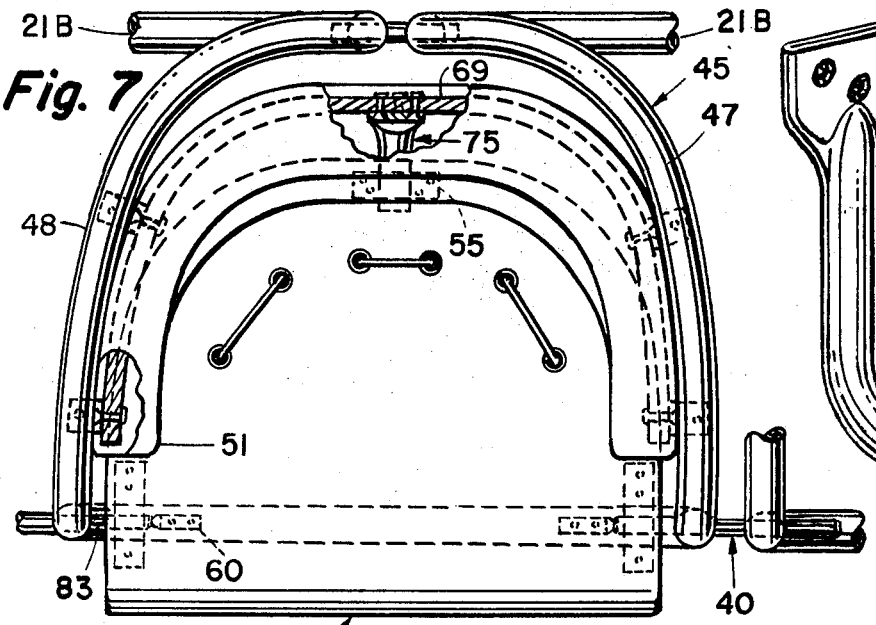
FIGS. 7, 8 and 9 are respectively top, front and fragmentary side views of the in-line grouping.
Figure 10:
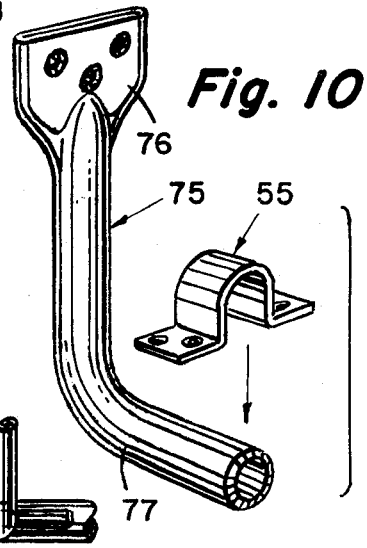
FIG. 10 is an exploded perspective view of the back-seat connection.
Figure 8:
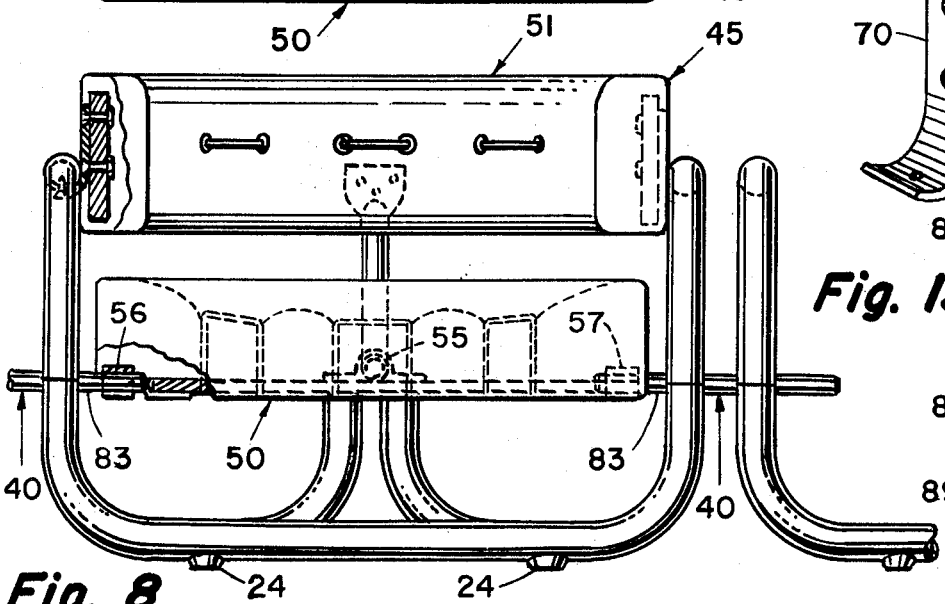
Figure 9:
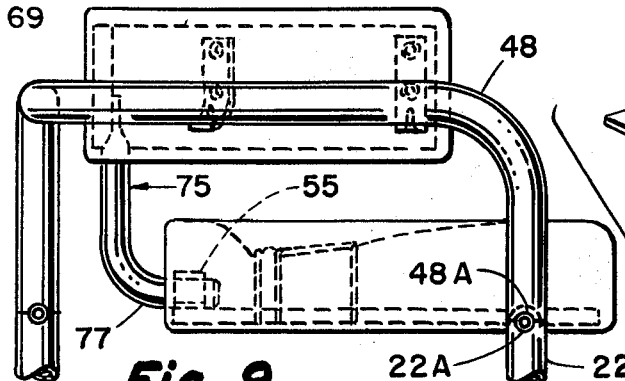

In all of the groupings thus far disclosed, the chair seats and backs may be attached to the frame in a similar manner which is illustrated in FIGS. 7–11 and 14–18, discussed presently. Referring then to FIGS. 7–9, there is shown a single chair from the in-line grouping of FIGS. 4–6; and it is an intermediate chair, such as the chair designated 45 in FIG. 4.

The chair includes a seat assembly generally designated 50 and a back assembly 51. Referring to FIGS. 17 and 18, the seat assembly includes a rigid seatboard 53 of the desired shape. It is provided at its rear with an inverted U-shaped, flanged bracket 55 which is attached by screws to the seatboard 53. It also includes first and second similar flanged brackets 56, 57 which are secured to the bottom surface of the seatboard and located in notches 58, 59 respectively in the seatboard. Immediately inboard of the side brackets 56, 57, are spring clips 60, 61. As seen better in FIG. 18, the spring clip 60 is secured to the bottom of the seatboard and extends laterally upwardly to define a catch element 64 immediately adjacent the inboard edge of the bracket 56. The seat may be provided with foldable layers of foam 65 commonly used in furniture; and it may be upholstered by a covering 66.

Figure 11:
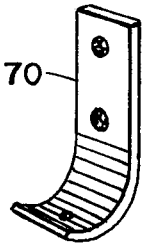
FIG. 11 is a perspective view of a connector between the seat back and side frame members.

Referring now to FIG. 14, the back assembly has a general U-shaped rigid support 69 to which there are attached four J-shaped mounting brackets 70 (seen better in FIG. 11). As seen in FIG. 15, the brackets 70 are secured by screws or rivets to the rigid support 69, and project laterally thereof. An L-shaped connector tube 75 is flattened at 76 to provide an attachment to the rear of the support 69 (see FIG. 16); and the lower portion of the connector tube, designated 77 in FIG. 14, extends forwardly to be received in the rear bracket 55 of the seat assembly (the combination is shown in exploded relation in FIG. 10, and in assembled relation in FIGS. 7–9).

Figure 12:
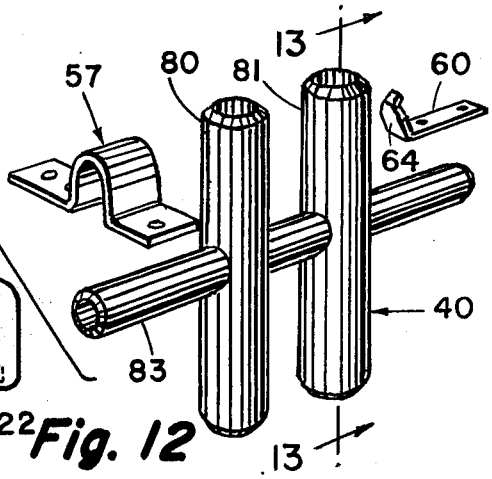
FIG. 12 is a perspective exploded view of the H-shaped frame connector and the seat connector elements.

Turning now to FIG. 12, the frame connector 40 includes a pair of upright tubular inserts 80, 81 which are joined together by a cross tube 83. The cross tube 83 is rigidly connected as by welding to the inserts 80, 81 to form a rigid frame connector element while, at the same time, providing support to the forward portions of the seat. That is, the left and right side brackets 56, 57 attached to the seatboard 53 straddle the protruding portions of the cross tube 83, as best seen in FIGS. 7 and 8, when the seat is assembled to the frame. Further, the clip 60 prevents removal of the seat from the frame because the spring portion thereof 64 fits into the opening of the cross tube 83 and prevents the seat from being lifted relative to the frame (see FIGS. 8 and 12).

Figure 13:
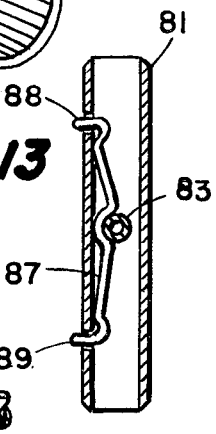
FIG. 13 is a cross sectional view taken through the sight line 13—13 of FIG. 12.

Turning now to FIG. 13, each of the inserts 80, 81 is provided with a spring 87 held in place by the cross tube 83 and having first and second ends 88, 89 extending rearward beyond the tube itself, but capable of being pressed inwardly. The upwardly turned end portions of the U-shaped front runner 21 as well as the forward vertical portions of the tubular side frame members are provided with semi-circular cut-aways designated respectively 22A and 48A in FIG. 8 for receiving the cross tube 83 of the frame connector 40. They are also provided with apertures for receiving the projecting ends 88, 89 of the spring 87 in the connector couples the frame elements together in a positive manner, yet can be removed by depressing the spring ends 88, 89 until they clear the tubular frame members which can then be pulled apart.

Figure 2:
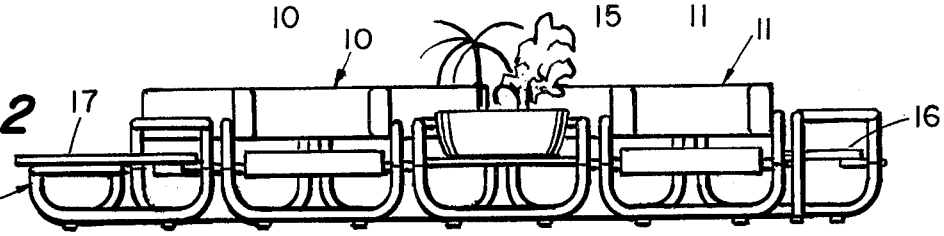
FIG. 2 is a front view of the grouping of FIG. 1.

It will thus be observed that the present invention provides for flexibility in a chair grouping with using a minimum of interchangeable parts. That is, the invention permits the construction of two lines of opposing chairs with individual chairs in a zig-zag pattern as seen in FIGS. 1–3, it permits a single in-line arrangement of chairs as seen in FIGS. 4–6, and it permits the construction of an individual chair, all of which carry the same general aesthetic appearance and quality with interchangeable connector and frame elements, as well as seats and backs. If it is desired to have a single contoured body portion for both the seat and back, such as that designated by reference numeral 90 in FIGS. 19 and 20, the present invention also permits that, while using the same frame, designated 91 in FIGS. 19 and 20 for a single chair, and this frame is similar to that described above except that the side frame members are attached to rear upright tubular legs 93, 94 by means of a frame connector 40.

Having thus described in detail preferred embodiments of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a grouping of chairs in side-by-side relation, the improvement comprising: chair means forming a seat and a back for each chair; a frame comprising a plurality of tubular frame elements for each chair including a U-shaped front runner extending along the floor beneath said chair and formed upwardly at the sides thereof, and first and second side frame members extending respectively from the ends of said front runner about the sides of said chair, and a pair of laterally extending runners behind each chair; first frame connector means for connecting the front runners of adjacent chairs together and for connecting said front runners to the side frame elements of adjacent chairs and for supporting the forward portion of the seat of each chair; second frame connector means for connecting the side frame members of each chair to the laterally extending runners; and means for connecting the back of each chair to the associated side frame members thereof.

2. The apparatus of claim 1 wherein said side frame members for each chair extends upwardly from and in axial alignment with the associated upwardly extending ends of said front runners, thence rearwardly around and toward the center of said back, and thence straight rearwardly thereof, thence downwardly, whereby the side frame members of adjacent chairs open to form cooperating side frame members for chair means facing the opposite direction, and wherein said laterally extending runners behind each of said first chairs forms a front runner for an oppositely facing chain means, thereby to form two rows of oppositely facing chairs in zig-zag relation.

3. The apparatus of claim 2 wherein each chair means includes a seat and a back, and wherein each of said first frame connector means includes laterally support means, the forward portions of said seats being connected to said laterally extending support means of said first frame connector means; each chair further including means for connecting said back to said side frame members and a tubular element interconnecting the rear of said back to the rear of said seat for each chair means.

4. The apparatus of claim 2 wherein each of said first frame connector means comprises a generally H-shaped rigid element having first and second laterally spaced inserts received respectively in said vertically aligned portions of said side frame members and front runners; and a laterally extending cross member rigidly interconnecting said insert members and extending laterally thereof for supporting the forward corner of an adjacent seat.

5. The apparatus of claim 4 wherein said cross member of said frame connector is tubular, and wherein said seat comprises a clip member adapted to extend into the tubular end of the cross member of said frame connector when said seat is assembled thereto to prevent removal thereof.

6. The apparatus of claim 1 wherein said side frame members extend about the sides of said chair toward the rear thereof and thence downwardly adjacent one another and aligned with corresponding upwardly turned portions of said laterally extending runners forming rear runners; thereby to form an in-line single row of chairs.

7. The apparatus of claim 6 wherein said rear runners each comprise a generally U-shaped floor runner in staggered relation with said front runners.

8. The apparatus of claim 7 wherein each of said chain means includes a seat and a back, said frame connectors connecting said front runners including first and second upright inserts received respectively in the aligned portions of adjacent runners and side frame members, and a cross member rigidly secured to said inserts to form a general H-shape, the seat portion of said chair means being at least partially supported by the cross member of said frame connectors.

* * * * *